US008727724B2

(12) United States Patent
Bruce et al.

(10) Patent No.: US 8,727,724 B2
(45) Date of Patent: May 20, 2014

(54) TURBINE BUCKET HAVING A RADIAL COOLING HOLE

(75) Inventors: Kevin Leon Bruce, Greer, SC (US); Matthew Robert Piersall, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1183 days.

(21) Appl. No.: 12/758,320

(22) Filed: Apr. 12, 2010

(65) Prior Publication Data

US 2011/0250078 A1 Oct. 13, 2011

(51) Int. Cl.
*F01D 5/18* (2006.01)

(52) U.S. Cl.
USPC ..... 416/92; 416/97 R

(58) Field of Classification Search
USPC ..... 415/115; 416/92, 97 R
See application file for complete search history.

(56) References Cited

U.S. PATENT DOCUMENTS

| | | | | |
|---|---|---|---|---|
| 2,972,182 | A * | 2/1961 | Kent | 29/889.721 |
| 3,044,745 | A * | 7/1962 | Stark | 416/92 |
| 3,301,528 | A * | 1/1967 | Malley | 416/96 R |
| 3,695,778 | A * | 10/1972 | Taylor | 416/92 |
| 4,416,321 | A | 11/1983 | Goddard et al. | |
| 4,529,357 | A * | 7/1985 | Holland | 416/92 |
| 5,117,626 | A * | 6/1992 | North et al. | 60/806 |
| 5,350,277 | A * | 9/1994 | Jacala et al. | 416/90 R |
| 5,413,463 | A | 5/1995 | Chiu et al. | |
| 5,472,316 | A | 12/1995 | Taslim et al. | |
| 5,482,435 | A * | 1/1996 | Dorris et al. | 416/97 R |
| 5,690,472 | A | 11/1997 | Lee | |
| 5,779,447 | A * | 7/1998 | Tomita et al. | 416/97 R |
| 5,857,837 | A | 1/1999 | Zelesky et al. | |
| 5,980,209 | A | 11/1999 | Barry et al. | |
| 6,102,658 | A | 8/2000 | Kvasnak et al. | |
| 6,126,396 | A | 10/2000 | Doughty et al. | |
| 6,152,695 | A | 11/2000 | Fukue et al. | |
| 6,254,346 | B1 | 7/2001 | Fukuno et al. | |
| 6,382,914 | B1 * | 5/2002 | Tressler | 416/97 R |
| 6,499,950 | B2 | 12/2002 | Willett et al. | |
| 6,554,571 | B1 * | 4/2003 | Lee et al. | 416/92 |
| 6,910,864 | B2 | 6/2005 | Tomberg | |
| 6,923,623 | B2 * | 8/2005 | Cleveland et al. | 416/97 R |
| 6,997,679 | B2 * | 2/2006 | Beddard et al. | 416/92 |

(Continued)

FOREIGN PATENT DOCUMENTS

| | | | |
|---|---|---|---|
| DE | 3706260 | A1 * | 9/1988 |
| GB | 808837 | | 2/1959 |
| GB | 855777 | | 12/1960 |

OTHER PUBLICATIONS

International Search Report and Written Opinion from EP 11161671 dated Jun. 13, 2013, pp. 1-7.

*Primary Examiner* — Edward Look
*Assistant Examiner* — Christopher R Legendre
(74) *Attorney, Agent, or Firm* — Cantor Colburn LLP

(57) ABSTRACT

A turbine bucket is provided and includes a shank interconnectable with a rotor and formed to accommodate coolant therein and an airfoil blade coupled to a radially outward portion of the shank and including a body formed to define a substantially radially extending cooling hole therein, which is disposed to be solely receptive of the coolant accommodated within the shank for removing heat from the body, the cooling hole being further defined as having a substantially non-circular cross-sectional shape at a predefined radial position of the body.

19 Claims, 4 Drawing Sheets

(56) References Cited

U.S. PATENT DOCUMENTS

| | | | | |
|---|---|---|---|---|
| 7,029,235 | B2 * | 4/2006 | Liang | 416/92 |
| 7,114,916 | B2 * | 10/2006 | Dube et al. | 415/115 |
| 7,163,373 | B2 | 1/2007 | Liang | |
| 7,207,775 | B2 * | 4/2007 | Muriithi | 416/92 |
| 7,901,180 | B2 | 3/2011 | Abdel-Messeh et al. | |
| 2005/0175454 | A1 * | 8/2005 | Dube et al. | 416/97 R |
| 2008/0273987 | A1 * | 11/2008 | Liang | 416/97 R |
| 2008/0279695 | A1 * | 11/2008 | Abdel-Messeh et al. | 416/97 R |
| 2011/0243711 | A1 * | 10/2011 | Vehr | 415/115 |
| 2011/0250078 | A1 * | 10/2011 | Bruce et al. | 416/96 R |

* cited by examiner

TURBINE BUCKET HAVING A RADIAL COOLING HOLE

BACKGROUND OF THE INVENTION

The subject matter disclosed herein relates to a turbine bucket having a radial cooling hole.

In turbine engines, such as gas turbine engines or steam turbine engines, fluids at relatively high temperatures contact blades that are configured to extract mechanical energy from the fluids to thereby facilitate a production of power and/or electricity. While this process may be highly efficient for a given period, over an extended time, the high temperature fluids tend to cause damage that can degrade performance and increase operating costs.

Accordingly, it is often necessary and advisable to cool the blades in order to at least prevent or delay premature failures. This can be accomplished by delivering relatively cool compressed air to the blades to be cooled. In many traditional gas turbines, in particular, this compressed air enters the bottom of each of the blades to be cooled and flows through one or more round machined passages in the radial direction to cool the blade through a combination of convection and conduction.

In these traditional gas turbines, as the temperature of the fluids increases, it becomes necessary to increase the amount of cooling flow through the blades. This increased flow can be accomplished by an increase in a size of the cooling holes. However, as the cooling holes increase in size, the wall thickness of each hole to the external surface of the blade decreases and eventually challenging manufacturability and structural integrity of the blade.

BRIEF DESCRIPTION OF THE INVENTION

According to one aspect of the invention, a turbine bucket is provided and includes a shank interconnectable with a rotor and formed to accommodate coolant therein and an airfoil blade coupled to a radially outward portion of the shank and including a body formed to define a substantially radially extending cooling hole therein, which is disposed to be solely receptive of the coolant accommodated within the shank for removing heat from the body, the cooling hole being further defined as having a substantially non-circular cross-sectional shape at a predefined radial position of the body.

According to another aspect of the invention, a turbine bucket is provided and includes a shank interconnectable with a rotor and formed to accommodate coolant therein and an airfoil blade coupled to a radially outward portion of the shank and including a body formed to define a plurality of substantially radially extending cooling holes therein, which are each disposed to be solely and independently receptive of the coolant accommodated within the shank for removing heat from the body, each cooling hole in a subset of the plurality of cooling holes being further defined as having a substantially non-circular cross-sectional shape at a predefined radial position of the body.

According to yet another aspect of the invention, a turbine bucket is provided and includes a shank interconnectable with a rotor and formed to accommodate coolant therein and an airfoil blade coupled to a radially outward portion of the shank and including a body having opposing pressure and suction surfaces extending between opposing leading and trailing edge, the body being formed to define a substantially radially extending cooling hole therein, which is disposed to be solely receptive of the coolant accommodated within the shank for removing heat from the body, the cooling hole being further defined with elongated sidewalls having profiles that are substantially parallel with those of the pressure and suction surfaces.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
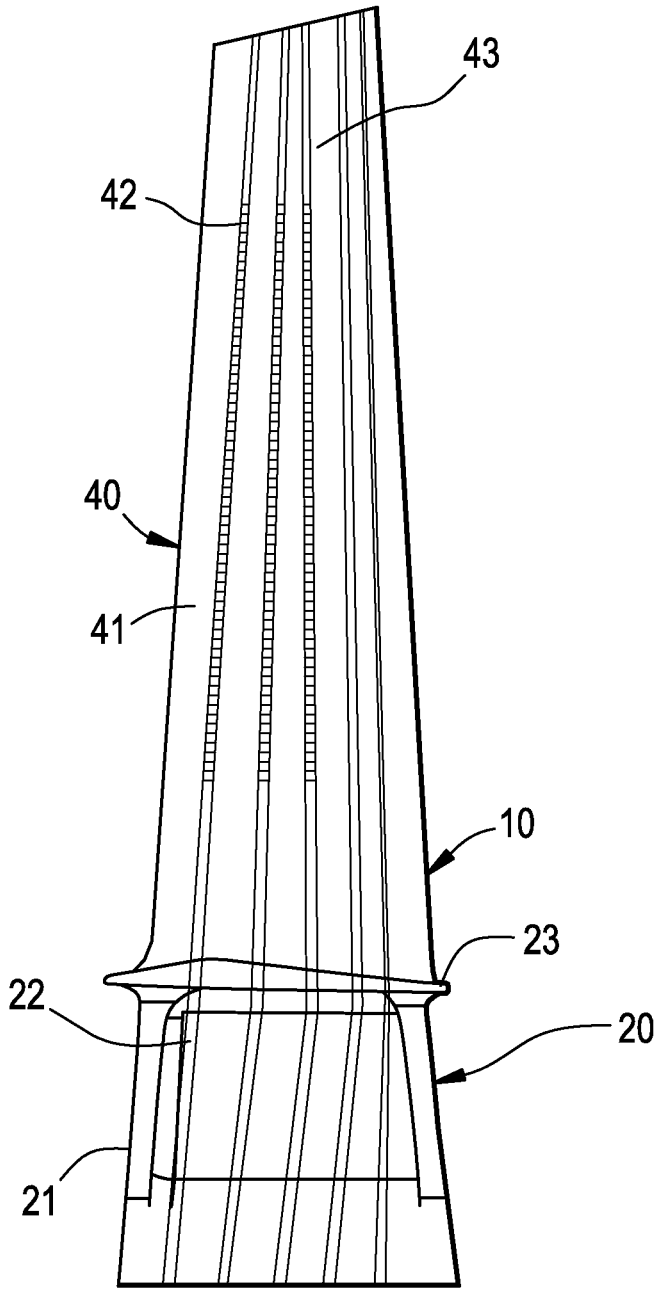
FIG. 1 is a plan view of a turbine bucket.

With reference to FIG. 1, a turbine bucket 10 is provided and includes a shank 20 and an airfoil blade 40. The shank 20 is interconnectable with and rotatable about a rotor of a turbine engine, such as a gas turbine engine, and includes a shank body 21 that is formed to define a cavity or a plurality of passages 22 therein. The cavity may be cast into the shank body 21 and the plurality of passages 22 may be machined. While both the cavity and the plurality of passages 22 may be employed, for purposes of clarity and brevity, the shank body 21 will hereinafter be described as being formed to define only the plurality of passages 22. The plurality of passages 22 may accommodate coolant, such as compressed air extracted from a compressor.

The shank body 21 may be formed with a fir-tree shape that, when installed within a dovetail seal assembly of the rotor, secures the shank 20 in a position relative to the rotor. In that position, each of the plurality of passages 22 is fluidly communicable with a supply of the coolant through, for example, a radially inward end of the turbine bucket 10.

The airfoil blade 40 may be coupled to a platform 23 at a radially outward portion of the shank 20 and may include an airfoil body 41 formed to define a substantially radially extending cooling hole 42 therein. The cooling hole 42 may be machined by way of electro-chemical machining processes (ECM), for example, and is disposed to be solely receptive of the coolant accommodated within the shank 20. That is, the cooling hole 42 does not communicate with any other cooling hole or cooling circuit and, therefore, does not receive coolant from any other source beside the shank 20.

The coolant is made to flow in a radial direction along a length of the cooling hole 42 by fluid pressure and/or by centrifugal force. As the coolant flows, heat transfer occurs between the airfoil body 41 and the coolant. In particular, the coolant removes heat from the airfoil body 41 and, in addition, tends to cause conductive heat transfer within solid portions 43 of the airfoil body 41. The conductive heat transfer may be facilitated by the airfoil body 41 being formed of metallic material, such as metal and/or a metal alloy that is able to withstand relatively high temperature conditions. The overall heat transfer decreases a temperature of the airfoil blade 40 from what it would otherwise be as a result of contact between the airfoil blade 40 with, for example, relatively high temperature fluids flowing through a gas turbine engine.

Figure 2:
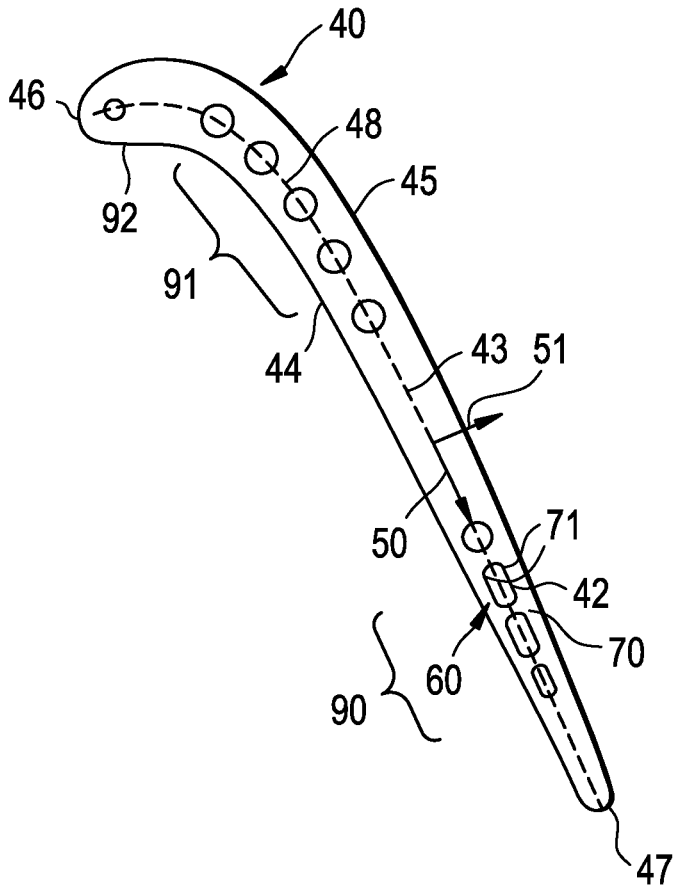
FIG. 2 is a schematic cross-sectional illustration of the turbine bucket of FIG. 1.

With reference to FIG. 2, the airfoil body 41 may extend in a radial direction from the platform 23 and may include opposing pressure and suction surfaces 44, 45 extending between leading and trailing edges 46, 47 to cooperatively define a camber line 48. The camber line 48 defines a major axis 50 and a minor axis 51, which is perpendicular to the major axis 50.

The cooling hole 42 may be defined as having a substantially non-circular cross-sectional shape 60 at any one or more predefined radial positions of the airfoil body 41. This non-circular shape 60 allows for an increased perimeter and larger cross-sectional area of the cooling hole 42 and leads to a greater degree of heat transfer without a thickness of the wall 70 having to be sacrificed beyond a wall thickness that is required to maintain manufacturability and structural integrity.

Where the cooling hole 42 is non-circular, the cooling hole 42 may have various alternative shapes including, but not limited to, elliptical or otherwise elongated shapes. The cooling hole 42 may be rounded or angled, regular or irregular. The cooling hole 42 may be symmetric about a predefined axis or non-symmetric about any predefined axis. The cooling hole 42 may be defined with elongate sidewalls 71 that have profiles mimicking local profiles of the pressure and suction surfaces 44, 45 such that the wall 70 is elongated with a thickness that is equal to or greater than a wall thickness required for the maintenance of manufacturability and structural integrity. Similarly, the cooling hole 42 may be longer in an axial direction of the airfoil body 41 than a circumferential direction thereof and/or may have an aspect ratio that is less than or greater than 1, non-inclusively, with respect to the camber line 48.

The substantial non-circularity of the cooling hole 42 may be localized, may extend along a partial radial length of the cooling hole 42 or may extend along an entire radial length of the cooling hole 42. In this way, the increased heat transfer facilitated by the substantial non-circularity of the cooling hole 42 may be provided to only a portion of the length of the airfoil body 41 or to a portion along the entire length of the airfoil body 41.

With reference to FIGS. 3-5 and 6-8, the turbine bucket 10 may further include a turbulator 80 positioned within the cooling hole 42. The turbulator 80 and, more generally, the turbulated section of the cooling hole 42 where the turbulator 80 is located may act to increase the heat transfer in the airfoil body 41. The turbulation acts to trip the flow of coolant through the cooling hole 42, which results in a boundary restart layer with an increased localized heat transfer coefficient. The turbulation can be along the entire perimeter of the hole, or at partial sections and may allow for part life of the airfoil body 41 to be lengthened and a required amount of cooling flow to be decreased. The turbulator 80 may be formed by various processes, such as electro-chemical machining (ECM).

The turbulator 80 may be a single component within the cooling hole 42 or may be plural in number. Where the turbulator 80 is plural in number, a series of turbulators 80 may be arrayed in a radial direction along a length of the cooling hole 42.

Figure 3:
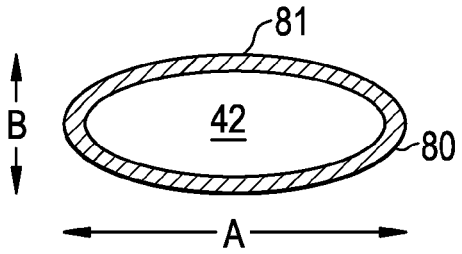
FIGS. 3-5 are cross-sectional views of turbulators according to embodiments.
Figure 4:
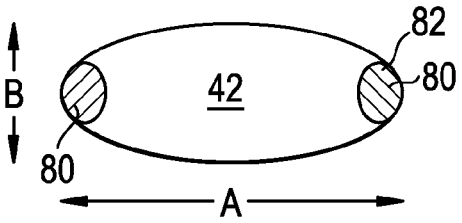
Figure 5:
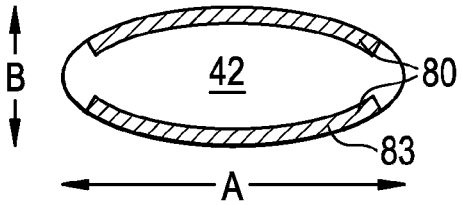
Figure 6:
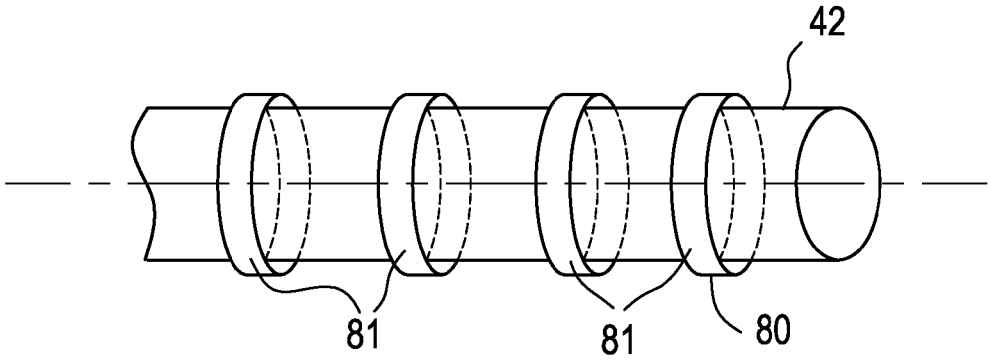
FIGS. 6-8 are plan views of the turbulators of FIGS. 3-5.
Figure 7:
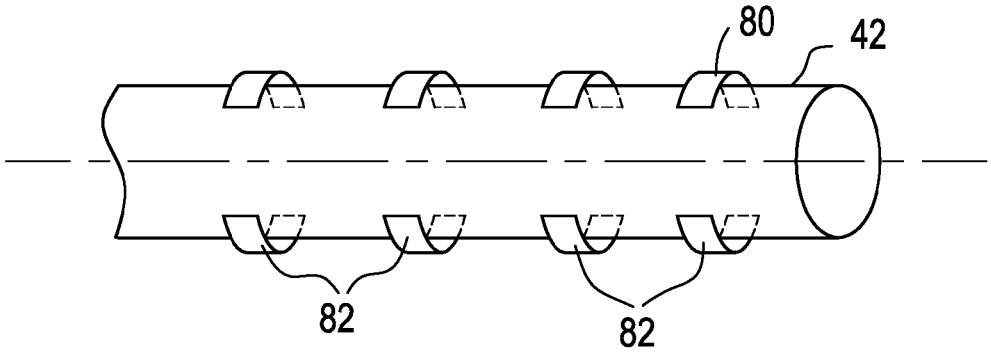
Figure 8:
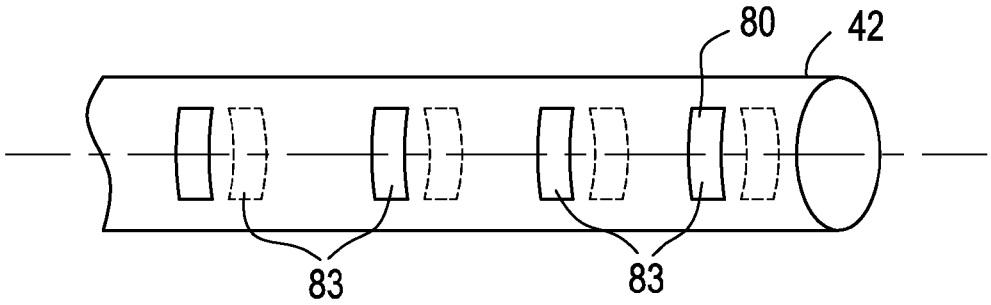

As shown in FIGS. 3 and 6, the turbulator 80 may be symmetric about any predefined axis. In this case, the turbulator 80 may be provided with a first configuration 81 in which the turbulator 80 extends around an entire perimeter of the cooling hole 42. The turbulator 80 may be symmetric about the axial direction (i.e., the A direction), as shown in FIGS. 4 and 7, in which case the turbulator 80 may be provided with the second configuration 82. The turbulator 80 may be symmetric about the circumferential direction (i.e., the B direction), as shown in FIGS. 5 and 8, in which case the turbulator 80 may be provided with the third configuration 83. Still further, the turbulator 80 may be non-symmetric and/or irregular.

With reference back to FIGS. 1 and 2, the airfoil body 41 may be formed to define a plurality of substantially radially extending cooling holes 42. Here, each cooling hole 42 is disposed to be solely and independently receptive of the coolant accommodated within the shank 20 for removing heat from the airfoil body 41. As mentioned above, where multiple cooling holes 42 are defined, the cooling holes 42 are independent from one another and do not fluidly communicate.

Where multiple cooling holes 42 exist, all or only a subset may be further defined as having the substantially non-circular cross-sectional shape. This subset may include one or more of the cooling holes 42. One or more turbulators 80 may be positioned within at least one of the cooling holes 42 in the subset. In this case, a position of each turbulator 80 within a cooling hole 42 is dependent or independent of a position of another turbulator 80 in another cooling hole 42.

The plurality of cooling holes 42 may be arranged in one, two or more groups, such as groups 90, 91 and 92, depending on design considerations. Here, each group may include one or more cooling holes 42. Of these, zero, one or more cooling holes 42 may be defined as having the substantially non-circular cross-sectional shape at the predefined radial position. Again, one or more turbulators 80 may be positioned within at least one of the cooling holes 42 in the subset. In this case, a position of each turbulator 80 within a cooling hole 42 is dependent or independent of a position of another turbulator 80 in another cooling hole 42.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine bucket, comprising:

a shank interconnectable with a rotor and formed to accommodate coolant therein; and an airfoil blade coupled to a radially outward portion of the shank and including a body having opposing pressure and suction surfaces extending between opposing leading and trailing edges, the body being formed to define a plurality of substantially radially extending cooling holes therein, each of which is disposed to be solely receptive of the coolant accommodated within the shank for removing heat from the body, the plurality of the cooling holes being arranged in groups of singular and multiple cooling holes comprising:

cooling holes defined as having a substantially circular cross-sectional shape at a predefined radial position of the body, and cooling holes defined as having a substantially non-circular cross-sectional shape at the predefined radial position of the body and with elongated sidewalls having profiles that are substantially parallel with those of the pressure and suction surfaces; and wherein one of the cooling hole groups is proximate to a trailing edge of the airfoil blade and defines a grouping of proximal cooling holes of mixed shapes with similarly-shaped cooling holes within the grouping having different sizes.

2. The turbine bucket according to claim 1, wherein at least one of the cooling holes comprises a turbulator.

3. A turbine bucket, comprising:

a shank interconnectable with a rotor and formed to accommodate coolant therein; and an airfoil blade coupled to a radially outward portion of the shank and including a body formed to define a plurality of substantially radially extending cooling holes therein, each of which is disposed to be solely receptive of the coolant accommodated within the shank for removing heat from the body, the plurality of the cooling holes being arranged in groups of singular and multiple cooling holes comprising:

cooling holes defined as having a substantially circular cross-sectional shape at a predefined radial position of the body, and cooling holes defined as having a substantially non-circular cross-sectional shape at the predefined radial position of the body; and wherein one of the cooling hole groups is proximate to a trailing edge of the airfoil blade and defines a grouping of proximal cooling holes of mixed shapes with similarly-shaped cooling holes within the grouping having different sizes.

4. The turbine bucket according to claim 3, wherein the shank comprises a shank body through which a machined cooling passage extends.

5. The turbine bucket according to claim 3, wherein the shank comprises a shank body in which a cavity is defined.

6. The turbine bucket according to claim 3, wherein the airfoil blade body comprises opposing pressure and suction surfaces extending between a leading edge and the trailing edge, and the cooling holes defined as having the substantially non-circular cross-sectional shape at the predefined radial position of the body are defined with elongate sidewalls having profiles that are substantially similar to those of the pressure and suction surfaces.

7. The turbine bucket according to claim 3, wherein the cooling holes defined as having the substantially non-circular cross-sectional shape at the predefined radial position of the body are longer in one dimension than another.

8. The turbine bucket according to claim 3, wherein the cooling holes defined as having the substantially non-circular cross-sectional shape at the predefined radial position of the body have an aspect ratio greater than 1 with respect to a camber line of the airfoil blade body.

9. The turbine bucket according to claim 3, wherein the substantial non-circularity of the cooling holes defined as having the substantially non-circular cross-sectional shape at the predefined radial position of the body extends along a partial radial length of the cooling hole.

10. The turbine bucket according to claim 3, wherein the cooling holes defined as having the substantially non-circular cross-sectional shape at the predefined radial position of the body are one of symmetric and non-symmetric about a predefined axis.

11. The turbine bucket according to claim 3, wherein the cooling holes defined as having the substantially non-circular cross-sectional shape at the predefined radial position of the body are non-symmetric about a predefined axis.

12. The turbine bucket according to claim 3, further comprising a turbulator positioned within one or more of the plurality of the cooling holes.

13. The turbine bucket according to claim 12, wherein the turbulator is plural in number within the one or more of the plurality of the cooling holes.

14. The turbine bucket according to claim 12, wherein the turbulator is one of symmetric and non-symmetric about a predefined axis.

15. A turbine bucket, comprising:

a shank interconnectable with a rotor and formed to accommodate coolant therein; and an airfoil blade coupled to a radially outward portion of the shank and including a body formed to define a plurality of substantially radially extending cooling holes therein, which are each disposed to be solely and independently receptive of the coolant accommodated within the shank for removing heat from the body, one or more cooling holes in a subset of the plurality of cooling holes proximate to a trailing edge being further defined as having a substantially non-circular cross-sectional shape at a predefined radial position of the body, and one or more cooling holes in the subset of the plurality of cooling holes proximate to the trailing edge being further defined as having a substantially circular cross-sectional shape at the predefined radial position of the body, wherein the cooling holes of substantially non-circular cross-sectional shape comprise different sizes.

16. The turbine bucket according to claim 15, wherein the subset comprises a plurality of cooling holes.

17. The turbine bucket according to claim 16, further comprising a turbulator positioned within at least one of the cooling holes in the subset.

18. The turbine bucket according to claim 17, wherein a turbulator position within a cooling hole is independent of a turbulator position in another cooling hole.

19. The turbine bucket according to claim 15, wherein the plurality of cooling holes are arranged in one, two or more groups, each group including one or more cooling holes.

* * * * *